US005595169A

United States Patent [19]

Brown, Jr.

[11] Patent Number: 5,595,169

[45] Date of Patent: Jan. 21, 1997

[54] HYDRAULIC STABILIZER FOR BOW

[76] Inventor: Franklin C. Brown, Jr., P.O. Box 9219, Akron, Ohio 44305

[21] Appl. No.: 362,943

[22] Filed: Dec. 23, 1994

[51] Int. Cl.[6] ..... F41B 5/20

[52] U.S. Cl. ..... 124/89

[58] Field of Search ..... 124/89; 188/378

[56] References Cited

U.S. PATENT DOCUMENTS

| | | | |
|---|---|---|---|
| 4,893,606 | 1/1990 | Sisko | 124/89 |
| 5,370,104 | 12/1994 | Neie | 124/89 |
| 5,385,136 | 1/1995 | Thomas | 124/89 |

FOREIGN PATENT DOCUMENTS

| | | | |
|---|---|---|---|
| 1497441 | 7/1989 | U.S.S.R. | 124/89 |
| 1296201 | 11/1972 | United Kingdom | 124/89 |

*Primary Examiner*—John A. Ricci
*Attorney, Agent, or Firm*—Oldham & Oldham Co., LPA

[57] ABSTRACT

The present invention provides a device for stabilizing a bow, to enable the archer/hunter to be more accurate while shooting and to enable an archer to properly balance a bow. The invention is attached to the bow by a threaded hole on the forearm. The balancing of the bow is accomplished by the use of a stabilizer which has an axially adjustable hydraulic cylinder or capsule. The hydraulic cylinder is axially movable within a housing and can be adjusted by a slot and/or locating holes to a desired position which enables the archer to balance the bow. Pistons, sealed and housed in a cylinder, move axially on the main stabilizer body to successfully control noise, vibration, bow movement, torque, and aids in achieving a smooth release of an arrow.

17 Claims, 3 Drawing Sheets

HYDRAULIC STABILIZER FOR BOW

TECHNICAL FIELD

The present invention relates to archery equipment and more specifically, to a stabilizer for the purpose of balancing a bow, stabilizing a bow, and helps in eliminating excess noise when an arrow is launched from a bow at a target, takes torque out of a bow, helps to accomplish a more smooth release of an arrow, and eliminates vibration when an arrow is launched. Also, in target shooting a stabilizer aids the archer in keeping a tighter group of arrows in a given area thus aiding the archer in becoming more accurate while shooting various distances.

BACKGROUND OF THE INVENTION

Bows and stabilizers are used in the sport of archery for target practice, amateur and professional competition, as well as hunting. Solid stabilizers (usually made from steel) were first introduced in the field of archery to aid the archer in achieving more accurate and tighter grouping of arrows. With the introduction of the modem compound bow, which shoots harder and faster, the hydraulic stabilizer of the present invention is more effective in aiding the archer in achieving even greater results. This hydraulic stabilizer can be used on the modern recurve bow as well.

Current hydraulic stabilizers are available with various weights that can be attached to the extended end of said device to aid an archer in balancing the bow. Furthermore, more expensive and extra parts or accessories are needed in which an archer must contend with, therefore, the hydraulic stabilizer becomes less suitable to the archer.

SUMMARY OF THE INVENTION

The present invention provides a device for stabilizing a bow to enable the archer/hunter to be more accurate while shooting and also to enable an archer to properly balance a bow by moving the hydraulic cylinder to a desired position. All modern compound and recurve bows have a five sixteenths twenty-four threaded hole on the forearm that is pointed toward the target for the purpose of securing a stabilizer. The present invention has a slot and/or locating holes that are parallel with the main body of the stabilizer to enable an archer to adjust the hydraulic cylinder or capsule to a position that will balance the bow. Balancing the bow with the adjustable cylinder is important because each bow can be balanced according to each individuals strength as well as the poundage each individual bow is set for. Each bow is equipped with accessories to suit the individual archers needs, therefore, the ability to adjust the hydraulic stabilizer is even more valuable because the hydraulic cylinder can be placed in a position that is critical to maintain good balance.

It is, therefore, an object of the present invention to provide a device that will aid an archer in eliminating torque when an arrow is launched.

The further an object is extended from a main body, the more torque is eliminated. The ability to adjust the present invention, and the extension rod is critical to the archer.

It is, therefore, an object of the present invention to provide a device that will help eliminate noise when the archer is in the field, when silence is needed.

Another object of the invention is to help eliminate noise and to accomplish a smooth release with more accurate results.

It is, therefore, an object of the present invention to be lighter in weight because the hydraulic cylinder can be extended to a maximum position by a main base that is hollow and is constructed of a light weight plastic or non-ferrous metal such as aluminum or magnesium. Other hydraulic stabilizers are heavier due to their construction, i.e. the entire main base is filled with oils, or other fillers, such as plastic spacers and oils.

Another advantage is a solid rod extended from the threaded hole on the forearm of the bow that will allow the hydraulic cylinder to extend even to greater distances. The length of the stabilizer is critical because a bow becomes more accurate and stable when the hydraulic cylinder is extended to greater lengths.

Another advantage is the archer can move the hydraulic cylinder to a shorter position while walking, or on an archery range when the bow is not in use. This will help prevent damage to the bow or stabilizer.

Still another advantage is the adjustable hydraulic cylinder of the stabilizer which may be moved to a shorter position for the purpose of transportation in a bow case.

Another advantage is that the cylinder can be adjusted to aid the archer in relation to his or her strength where stronger archers should commonly have more extended stabilizers.

The present invention is attached to the bow by a threaded hole on the forearm. All modern bows are manufactured with said hole for the purpose of attaching the stabilizer to the bow.

The hydraulic cylinder is adjusted axially and is marked with a series of percentage marks, numbers, arrows, or lines to enable an archer to quickly move said cylinder to a predetermined or desired location.

These and other objects and advantages will become more readily apparent from the more detailed discussion of the preferred embodiment taken in conjunction with the drawing wherein similar elements are identified by like numerals through several views. Such advantages are achieved by an adjustable hydraulic cylinder that will slide parallel with the mounted tube which is attached to the bow by a threaded stud.

DETAILED DESCRIPTION OF THE PREFERRED EMBODIMENT

Now this invention will be described in detail with reference to the preferred embodiments thereof.

Figures 1, 2, 3, 4, 4A, 5, 6:
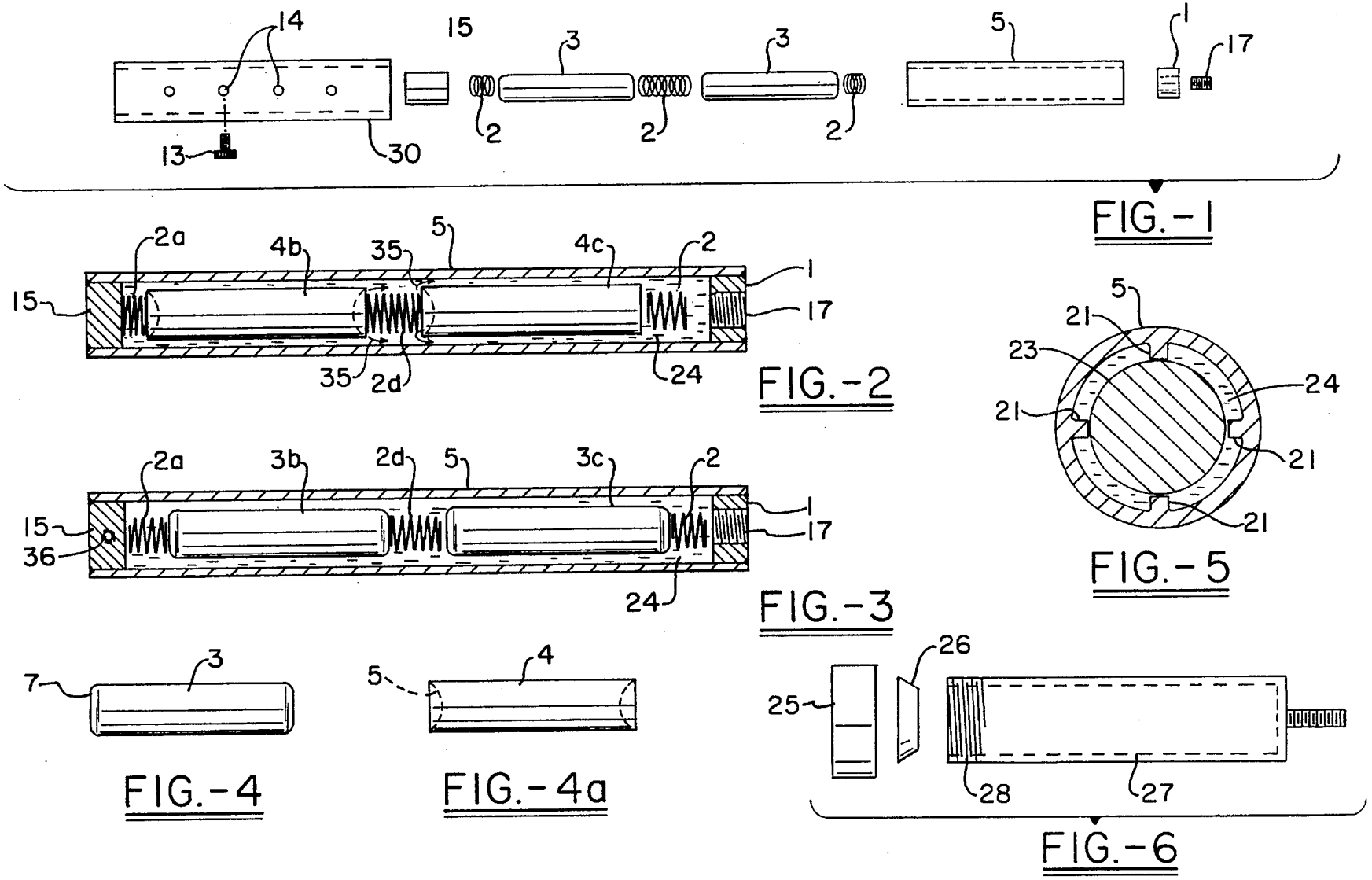
FIG. 1 is an exploded view of the present invention.
FIG. 2 is a split view of the hydraulic cylinder and exposes the functions and mechanics showing two pistons. Multiple pistons function more efficiently.
FIG. 3 is a split view of the hydraulic cylinder and exposes a piston that is different in nature than FIG. 2.
FIG. 4 and FIG. **4*a* shows two types of pistons as seen in FIG. 2 and FIG. 3**.
FIG. 5 is an enlarged cross-sectional view of the hydraulic cylinder that exposes ribs for the purpose of the free floating piston to rest or ride on in order to maintain a smoother action.
FIG. 6 is a side view which shows the main adjusting body with a locking nut and a locking flange for securing the hydraulic cylinder.
Figure 5A:
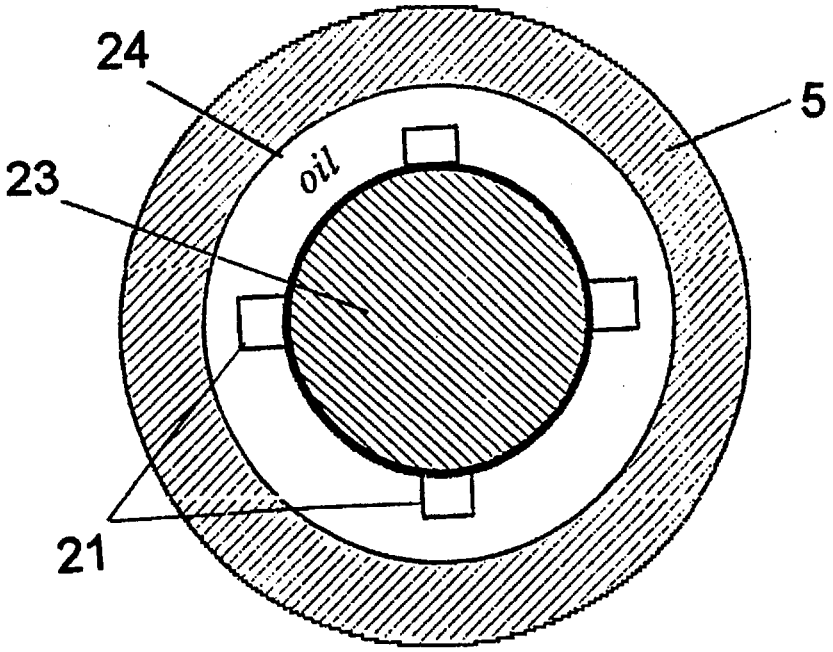
FIG. 5A is an enlarged cross-sectional view of the hydraulic cylinder that shows ribs on the hydraulic piston body for the purpose of the hydraulic piston body to rest or ride against the hydraulic cylinder, in order to maintain a smoother action.

FIG. 1 discloses an exploded view of the present invention which will be used in references to components of the invention and will be referred to throughout the detailed descriptions.

Figure 8:
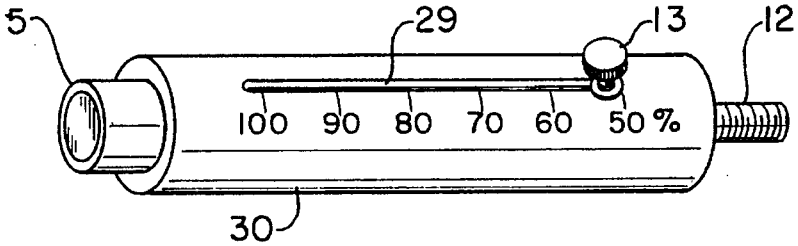
FIG. 8 is a perspective view which shows a closed hydraulic stabilizer that is completed and ready to be mounted to the bow. The adjusting screw is moved along a parallel slot to open the stabilizer to a desired position.

FIG. 8 displays an assembled hydraulic stabilizer in a closed position with a slot 29 running along and parallel with the main body 31 to allow exact positioning of the hydraulic cylinder or capsule 5. A thumb screw 13 is used to secure the hydraulic cylinder 5 to a desired position.

Figure 9:
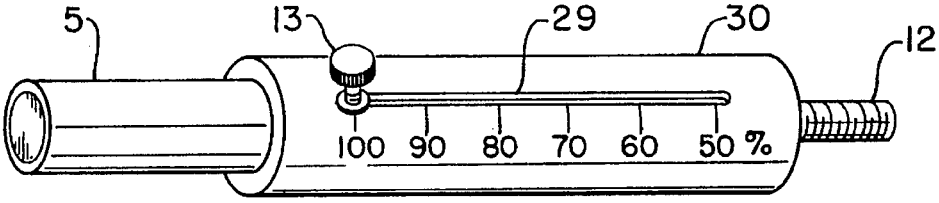
FIG. 9 is a perspective view which shows the stabilizer of FIG. 8 in an extended position.

FIG. 9 displays an assembled hydraulic stabilizer in the extended position.

Figure 10:
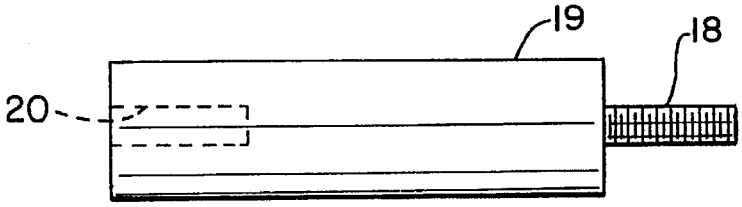
FIG. 10 is a side view of an extension rod that is manufactured in various lengths for the purpose of extending the hydraulic stabilizer to greater lengths.
Figure 11:
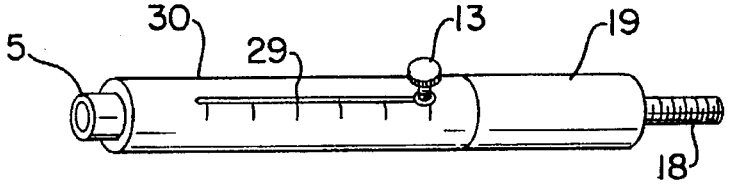
FIG. 11 is a perspective view which shows the extension rod 19 (FIG. 10) mounted to the hydraulic stabilizer.

FIG. 10 displays an extension bar 19 that is threaded onto detail 12 (FIG. 8) by a 5/16-24 threaded hole 20 (FIG. 10), and detail 18 is in turn threaded into the 5/16 24 threaded hole provided for on the bow, to enable the archer to extend the hydraulic stabilizer to even greater distances from the bow in order to achieve desired results, as shown in FIG. 11.

The stabilizer is effectively a counterweight in its nature, because it is extended to a forward position and toward the target, therefore, when an arrow is launched, said stabilizer holds bow in position until arrow clears the bow, effectively taking torque out of the bow and allowing an archers wrist and grip to stay on said target until arrow clears bow when launched.

Pistons *4b*, *4c* are housed and sealed into a cylinder 5 (see FIG. 8 and FIG. 2) and are slidably moved axially on main stabilizer body 29 and anchored in desired position by a thumb screw 13. Pistons perform several functions as follows: as a counterweight as disclosed in previous paragraph, when an arrow is launched, pistons move axially and are cushioned by compression springs 2, 2*a*, 2*d* (FIG. 2), a liquid bath 24 with free floating pistons absorb energy build-up in the bow when arrow is actually launched successfully controlling noise, vibration, bow movement, torque, and aids in achieving a smooth release of an arrow.

Percentage marks (FIG. 8) are provided on the stabilizer main body 31 for the purpose of balancing a bow. Proper positioning is determined by each individual archer according to their strength, poundage the bow is set for, and accessories that are on the individual bow. The further a stabilizer is extended in a forward position and away from main body of bow will generate greater results in accuracy, and again the proper positioning of hydraulic cylinder is determined by each individual archer as aforementioned in this paragraph.

Extension bar (FIG. 10) may be constructed in random lengths and various diameters, an average diameter is 5/8", an average length consisting of 4" to 24", and is preferably constructed of hollow or solid non-ferrous metals such as aluminum or magnesium or rigid plastics due to the light weight of said materials.

FIG. 2 discloses a split view of the actual hydraulic cylinder that is preferably constructed of rigid plastic or light weight non-ferrous metals such as aluminum or magnesium. FIG. 2 shows a view of the hydraulic cylinder with floating pistons *4b* and *4c* in a forward position as the archer launches an arrow from a bow with compression spring 2*a* collapsed from the force of moving pistons *4b* and *4c*. The pistons *4b* and *4c* have concave ends 6 as shown in FIG. 4*a*. These concave ends 6 will trap fluids/oils when an arrow is launched from a bow causing the piston *4b* to have a liquid cushion as the compression spring 2*a* is collapsed against end plug 1 FIG. 2. Piston *4c* in FIG. 2 causes compression spring 2*d* to collapse, furthermore, forcing liquids/oils in direction of arrows 35 allowing second piston *4c* to maintain a smooth and silent function when an arrow is launched from a bow.

FIG. 3 shows two pistons *3b* and *3c* that are preferably constructed of mild steel, iron or lead, with tapered or beveled piston ends 7 (FIG. 4) that will actually lilt off the housing wall 5 when an arrow is launched. The tapered or beveled piston ends 7 will allow fluids/oils 24 (FIG. 5) to flow with less resistance due to the aerodynamic design of the tapered or beveled ends, permitting a smaller housing (FIGS. 1,3) and, consequently, less oil is needed, therefore, a lighter and more efficient stabilizer is generated. Suitable hydraulic fluid comprises one or more fluids such as water, oil, antifreeze or mercury. The viscosity of the fluid preferably ranges from about 5 weight to about 25 weight. The piston may be constructed of various lengths, diameters and weights to achieve a desired stabilizer. An average diameter is 5/8", a good length is about 3" and a good weight is about 3 ozs.

FIG. 5 is a cross-sectional view of an alternative embodiment for a hydraulic cylinder 5. Raised multiple ribs 21 hold piston 23 off the housing wall 5, creating less resistance by moving axially on ribs 21 and permitting oil to flow smoothly and evenly when an archer launches an arrow. The ribs may be formed either on the inner surface of the main body 28 or on the outer surface of piston 5. This method of manufacturing ribs will be extruded or molded when the hydraulic cylinder is produced, therefore, being less expensive to manufacture.

FIGS. 2 and 3 show end plug 1 (also shown in FIG. 1). The end plug is welded or adhesively attached to housing 5 to effectively seal liquids/oils into the hydraulic cylinder. The end plug 1 has a socket pipe plug 17 (preferably 1/8" socket pipe plug) that will permit liquids/oils to be introduced into the hydraulic cylinder after construction. The socket pipe plug 17 may be removed to replace oils/liquids due to climate changes when viscosity of oils/liquids may change in order to maintain good action in the hydraulic stabilizer as shown in FIGS. 2 and 3.

FIGS. 1, 2 and 3 show a plug 15 that is welded or bonded to housing 5 to seal oils/fluids. Plug 15 FIG. 3 has a tapped hole 36 FIG. 3 to accept a screw or stud 13 FIG. 1 which is inserted into one of several selected holes 14 FIG. 1 and threaded into plug 15 FIG. 1 in order to secure the hydraulic cylinder in a desired position or location on the main adjusting body 30 FIG. 1.

FIG. 6 shows an alternative view of the main adjusting body 27 with a threaded end 28 that will accept nut 25 and effectively secure the adjustable hydraulic cylinder 5 (FIGS. 1 and 2) to a given position by screwing nut 25 against tapered flange 26 to threaded end 28 of main adjusting body 27 (FIG. 6), therefore, tapered flange 26 will be compressed against the hydraulic cylinder 5 (FIG. 1) successfully locking hydraulic cylinder 5 (FIG. 1) into a desired position.

Figure 7:
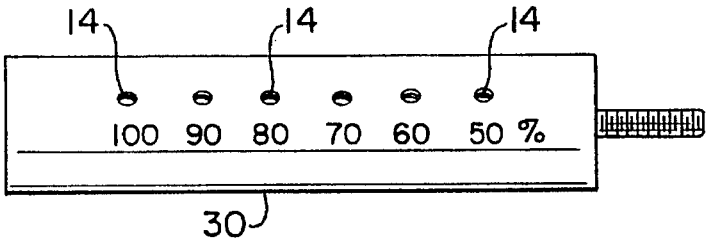
FIG. 7 is a side view which shows the main adjusting body with a series of holes that are marked with percentage numbers for adjusting the hydraulic cylinder.

FIG. 7 displays a view of the main adjusting body 30 (also shown in FIG. 1) with multiple holes 14 that will accept a locating stud 13 (FIG. 1) to a desired hole. Each hole 14 will have a percentage number (as seen in FIG. 7) with 50% being in the shortest position and 100% being in the extended, for the purpose of adjusting the stabilizer and maintaining proper balancing of the bow.

Figure 12:
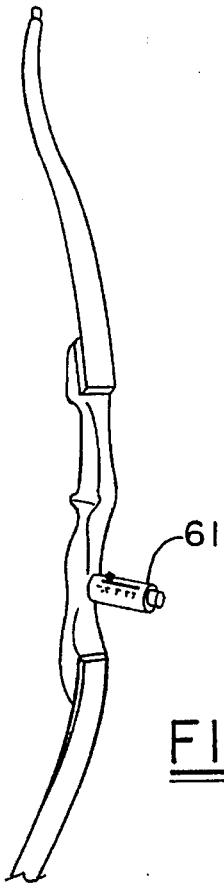
FIG. 12 shows the hydraulic stabilizer mounted to the bow.

FIG. 12 displays bow (60) with hydraulic stabilizer (61) attached.

What is claimed is:

1. A device for stabilizing an archery bow, said bow comprising a central body portion with opposite limbs connected by a bow string, said stabilizing device comprising:

a hollow elongated housing with a first end with means to attach said housing to the bow, and a second open end;

a sealed capsule with hydraulic motion absorbing means therein, said capsule having an elongated body with a first and a second end, said capsule being of a size to be received within said hollow elongated housing and axially slidable therein with said first end of said capsule closer to said bow than said second end; and fastening means functioning to releasably secure said capsule in one of numerous fixed positions relative to said housing thereby adjusting the distance of said capsule from said archery bow.

2. The device of claim 1 wherein said elongated housing is attached to the central body portion of said bow.

3. The device of claim 1 wherein said means to attach said housing to the bow is a threaded screw which extends from the first end of the housing and is receivable in a receptacle in the bow.

4. The device of claim 1 wherein said capsule contains a volume of hydraulic fluid and at least one piston member capable of axial movement within said capsule.

5. The device as recited in claim 4 wherein said hydraulic fluid has a viscosity ranging from about 5 weight to 25 weight.

6. The device as recited in claim 4 wherein said piston is made from one or more metallic materials selected from the group consisting of lead, iron, mild steel.

7. The device as recited in claim 4 wherein said device comprises one or more ribs formed on an inner surface of said capsule for preventing substantial frictional contact between a piston and said capsule inner surface.

8. The device as recited in claim 4 wherein said device comprises one or more ribs formed on an outer surface of said at least one piston member for preventing substantial frictional contact between a piston and an inner surface of said hydraulic body.

9. The device of claim 4 wherein said capsule contains at least two pistons capable of axial movement within said capsule.

10. The device of claim 9 further comprising a spring member between two adjacent pistons.

11. The device of claim 4 comprising at least one spring member between a piston and an end of said capsule.

12. The device of claim 4 wherein said at least one piston is a solid elongated body.

13. The device of claim 4 wherein said hydraulic fluid comprises one or more fluids selected from the group consisting of water, oil, antifreeze and mercury.

14. The device of claim 4 further comprising a plug at said first or second end of said capsule to permit hydraulic fluid to be introduced into said capsule.

15. The device of claim 1 further comprising:

either an elongated slot or a series of holes through the side of said elongated housing, parallel to its length and between the two ends thereof;

said fastening means attached to said capsule and extending through said slot or one of said series of holes through said housing and selectably tightenable to lock said capsule into a fixed position with respect to said housing;

whereby said fastening means may be released and said capsule may be slid relative to said housing to another location and said fastening means may be tightened through another location of said slot, or through another one of said series of holes, thus adjusting the distance of said capsule from said archery bow.

16. The device of claim 15, further including markings along said slot or series of holes to provide visual indication of the location of said capsule relative to said housing.

17. The device of 1, further comprising an extension bar having a threaded screw projecting from a first end, and an internally threaded receptacle at a second end, whereby the threaded screw which extends from the first end of the housing may be received in the internally threaded receptacle of the bow, thus extending the distance between the stabilizing device and the bow.

* * * * *